US009903646B2

(12) United States Patent
Turney et al.

(10) Patent No.: US 9,903,646 B2
(45) **Date of Patent: *Feb. 27, 2018**

(54) APPARATUS FOR ETHANE LIQUEFACTION WITH DEMETHANIZATION

(71) Applicant: L'Air Liquide, Societe Anonyme pour l'Etude et l'Exploitation des Procedes Georges Claude, Paris (FR)

(72) Inventors: Michael A. Turney, Houston, TX (US); Paul Terrien, Paris (FR); Yasser Jebbari, Vincennes (FR)

(73) Assignee: L'AIR LIQUIDE SOCIETE ANONYME POUR L'ETUDE ET L'EXPLOITATION DES PROCEDES GEORGES CLAUDE, Paris (FR)

( * ) Notice: Subject to any disclaimer, the term of this patent is extended or adjusted under 35 U.S.C. 154(b) by 226 days.

This patent is subject to a terminal disclaimer.

(21) Appl. No.: 14/877,236

(22) Filed: Oct. 7, 2015

(65) Prior Publication Data

US 2016/0097589 A1 Apr. 7, 2016

Related U.S. Application Data

(60) Provisional application No. 62/060,609, filed on Oct. 7, 2014.

(51) Int. Cl.
*F25J 1/00* (2006.01)
*F25J 1/02* (2006.01)

(52) U.S. Cl.
CPC ..... *F25J 1/0022* (2013.01); *F25J 1/0052* (2013.01); *F25J 1/0055* (2013.01); *F25J 1/0212* (2013.01); *F25J 1/0296* (2013.01); *F25J 2215/62* (2013.01)

(58) Field of Classification Search
CPC ..... F25J 1/0085; F25J 1/0092; F25J 1/0211; F25J 1/0212; F25J 3/0238; F25J 3/0233; F25J 3/0219; F25J 2215/62; F25J 2235/60; F25J 2270/66
See application file for complete search history.

(56) References Cited

U.S. PATENT DOCUMENTS

2004/0237581 A1* 12/2004 Paradowski ..... F25J 3/0219 62/620
2015/0233633 A1* 8/2015 Jiang ..... F25J 3/0223 62/611

* cited by examiner

*Primary Examiner* — Frantz Jules
*Assistant Examiner* — Brian King
(74) *Attorney, Agent, or Firm* — Justin K. Murray

(57) ABSTRACT

The apparatus for liquefying a gaseous stream received from a pipeline that is comprised predominantly of ethane and a relatively small amount of other components by using a mixed refrigerant refrigeration cycle loop incorporating heavy hydrocarbons, as well as a distillation column to remove constituents lighter than ethane. Prior to cooling in a main heat exchanger, the gaseous stream is split into two fractions. The main heat exchanger is configured to cool the first fraction before heading to the distillation column for separation therein. An expansion device expands the second fraction to produce a two phase fluid, which is separated in a gas/liquid separator, with the liquid fraction being introduced to the distillation column below the first fraction, and the gas fraction being cooled and then introduced to the distillation column at a point above the first fraction.

12 Claims, 1 Drawing Sheet

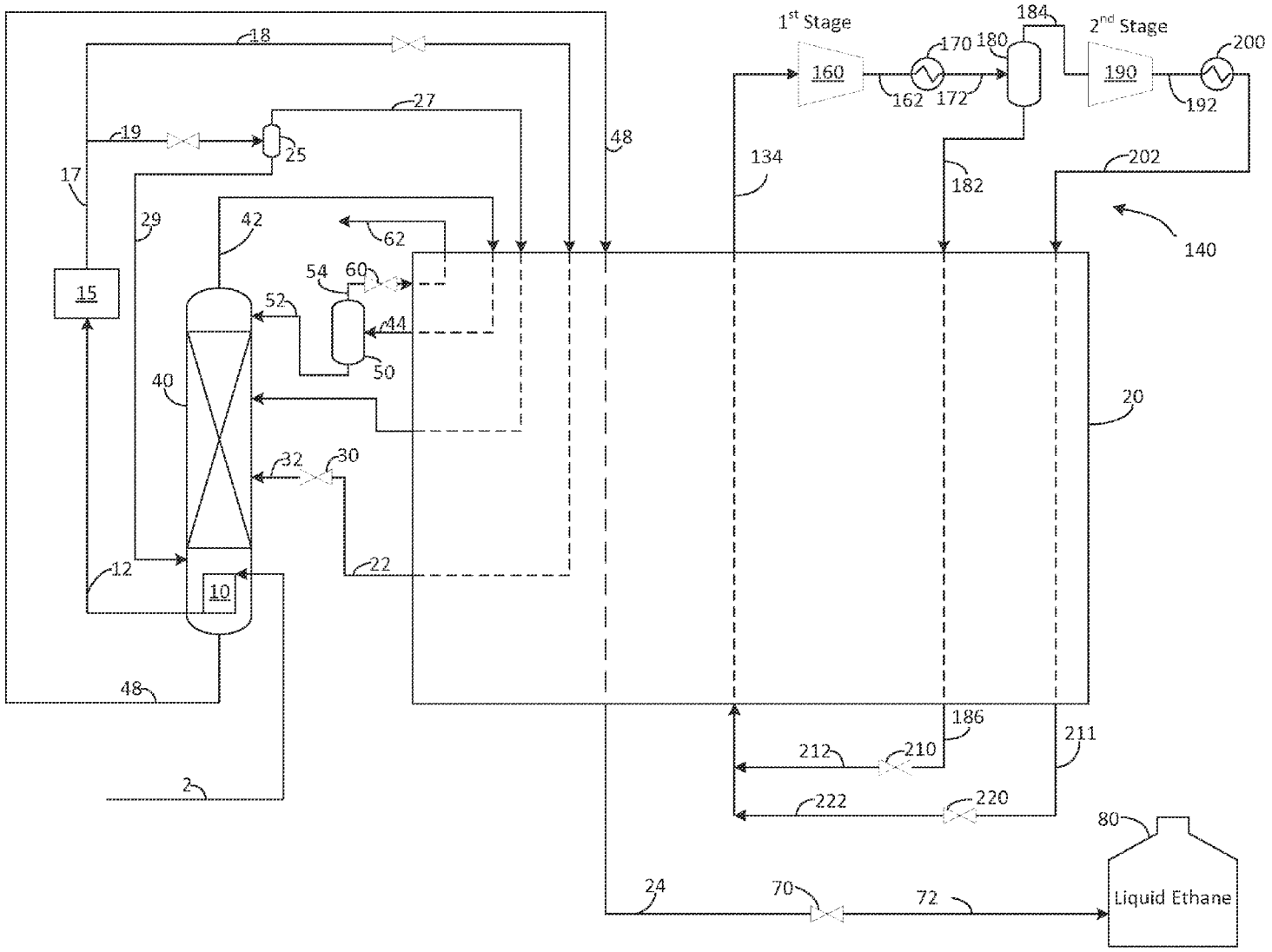
1st Stage
160
2nd Stage
190
Liquid Ethane
80
140
20
10
15
2

APPARATUS FOR ETHANE LIQUEFACTION WITH DEMETHANIZATION

CROSS REFERENCE TO RELATED APPLICATIONS

This application is a non-provisional application of U.S. Provisional Applicant No. 62/060,609, filed Oct. 7, 2014, which is herein incorporated by reference in its entirety.

TECHNICAL FIELD OF THE INVENTION

The present invention relates to an apparatus and method for liquefaction of ethane. More specifically, embodiments of the present invention are related to liquefying a gaseous stream received from a pipeline that is comprised predominantly of ethane and a relatively small amount of other components by using a mixed refrigerant loop incorporating heavy hydrocarbons (butane, and/or pentane), as well as a distillation column to remove constituents lighter than ethane.

BACKGROUND OF THE INVENTION

Liquefaction of methane (LNG) is well established, dating back to over 50 years. In certain cases, liquid ethane can also be produced directly from these LNG plants along with other higher hydrocarbon chain components and are called natural gas liquids (NGLs). However, many applications require the independent liquefaction of a gaseous ethane stream from a pipeline.

As such, there is a demand to liquefy a pressurized gaseous stream from a pipeline containing primarily ethane; however, this stream typically contains small amounts of methane (~3% vol), propane, ethylene and other components. Once liquefied, this fluid can be transported by truck or ship to distant locations where it is processed or "cracked" into ethylene; however, in order to ship in this manner, the methane content needs to be reduced to the range of ~0.5% vol methane. This creates a significant problem, since the gaseous ethane stream must be cooled to a temperature to allow for liquefaction of ethane, while also adding heat to vaporize off the methane.

Therefore, it would be desirable to have an improved process for liquefaction of a gaseous stream comprised predominantly of ethane that was simple and efficient.

SUMMARY OF THE INVENTION

The present invention is directed to a process and apparatus that satisfies at least one of these needs. In one embodiment, the process for ethane liquefaction can include using a mixed refrigerant as the primary refrigeration system, wherein the feed gas stream comprising predominately ethane is partially cooled and reduced in pressure to a distillation column having a bottom reboiler, wherein components such as methane and lighter are removed at the top and ethane and heavier components are removed from the bottom of the distillation column. In one embodiment, heat for the reboiler is provided by either cooling the feed gas stream or cooling the warm gas after the recycle compressor aftercooler. In another embodiment, a condenser duty for the distillation column is provided by integration with the main liquefaction heat exchanger, such that the gas from the top of the column is partially condensed in the heat exchanger. In one embodiment, the partially condensed fluid is sent to a liquid/gas separator, wherein the condensed liquid can be sent to the top of the distillation column as reflux, and the remaining vapor, which is primarily methane and lighter constituents, can be warmed in the main liquefaction heat exchanger to capture refrigeration and used as a fuel gas for other parts of the process or a nearby, external process. Ethane product is taken from the bottom portion of the distillation column, liquefied and subcooled at a pressure greater than ambient in the heat exchanger, reduced in pressure across valve 70 and then stored as product in a liquid storage tank. The feed ethane stream is typically from a pipeline or high pressure cavern (50-90 bar).

The embodiment may also include splitting the feed gas stream into two streams upstream the main heat exchanger. The first stream goes to the main exchanger for cooling therein and is fed to the column at a first intermediate point. The second stream is flashed to a lower pressure to a phase separator. The purpose is that the vapor from this separator will be richer in the lighter component (e.g., methane) such that after the vapor is liquefied in the exchanger, it can be sent to the distillation column at a second intermediate location that is located at least one tray higher than the first intermediate location. This advantageously provides more reflux at a higher location in the column. The liquid from the separator, which is richer in the heavier component ethane, is optionally cooled and then sent to a third intermediate location that is located at least one tray below the first intermediate location. Preferably, the third intermediate location is at a lower part of the column which matches the composition of the liquid with the fluid within the distillation column at that location.

By sending the methane rich vapor stream to a higher location in the column, the distillation is improved since the duty of the primary condenser can be reduced, thereby improving the overall liquefaction power of the plant.

In one embodiment of the invention, a method is provided for the liquefaction of ethane using a mixed refrigerant refrigeration cycle with demethanization. The method can include the steps of: providing an ethane feed under pressure, wherein the ethane feed is comprised primarily of ethane, wherein the ethane further comprises methane; cooling the ethane feed to a first temperature in a first heat exchanger, wherein the first temperature is sufficiently warm to prevent ice formation; removing water from the ethane feed upstream or downstream the first heat exchanger to form a dry ethane feed; splitting the dry ethane feed into a first portion and a second portion; cooling the first portion of the dry ethane feed in a main heat exchanger to form a partially cooled ethane stream; introducing the partially cooled ethane stream into a first intermediate location of a distillation column under conditions effective to cause an ethane rich liquid to accumulate near the bottom portion of the distillation column and a methane rich gas to accumulate near the top portion of the distillation column; expanding the second portion of the dry ethane feed and introducing the expanded second portion of the dry ethane feed to a phase separator; withdrawing a top gas from the top of the phase separator, cooling the top gas in the main heat exchanger, and then introducing the top gas into a second intermediate location of the distillation column, wherein the second intermediate location is located at least one tray above the first intermediate location; withdrawing a bottom liquid from the bottom of the phase separator and then introducing the bottom liquid into a third intermediate location of the distillation column, wherein the third intermediate location is located at least one tray below the first intermediate location; withdrawing an ethane stream from the bottom portion of the distillation column; and cooling the ethane stream from the bottom portion of the distillation column to produce liquid ethane product by exchanging heat with a mixed refrigerant refrigeration cycle within the main heat exchanger.

In optional embodiments of the method for liquefaction of ethane:

the method can also include the steps of withdrawing the methane rich gas from the top portion of the distillation column; and cooling the methane rich gas in the main heat exchanger to form a partially condensed top gas;

the method can also include the steps of introducing the partially condensed top gas to a gas/liquid separator to separate the condensed liquid from the non-condensables; and introducing the condensed liquid into the top portion of the distillation column as reflux;

the method can also include the steps of withdrawing the non-condensables from the gas/liquid separator, expanding the non-condensables, warming the non-condensables in the main heat exchanger to form a process fuel gas, wherein the process fuel gas is comprised of a methane rich gas as compared to the methane rich gas withdrawn from the top portion of the distillation column;

the ethane feed is pre-cooled in a bottom reboiler in heat exchange with a bottom liquid of the distillation column, such that the ethane feed acts as a reboiling fluid for the distillation column;

the bottom reboiler is a bath-type reboiler and is disposed within the bottom portion of the distillation column and the bottom liquid provides the bath fluid;

the bottom reboiler is disposed outside of the distillation column;

the partially cooled ethane stream is expanded prior to introduction to the distillation column;

the mixed refrigerant can include a heavy hydrocarbon selected from the group consisting of butane, pentane, and combinations thereof;

the mixed refrigerant further can include nitrogen and a light hydrocarbon selected from the group consisting of methane, ethane, ethylene, propane, and combinations thereof;

the mixed refrigerant cycle comprises the steps of: compressing a mixed refrigerant in a first compression section with subsequent cooling to produce a dual phase first compressed stream; separating the dual phase first compressed stream into a liquid refrigerant and a gaseous compressed stream; compressing the gaseous compressed stream in a second compression section with subsequent cooling to produce a second compressed stream; expanding the liquid refrigerant and the second compressed stream to produce a cooled refrigerant; and introducing the cooled refrigerant to the main heat exchanger under conditions effective for providing refrigeration for the method;

the ethane feed is at a pressure of at least 15 bar(a);

the mixed refrigerant cycle comprises the steps of: compressing a mixed refrigerant in a first compression section to produce a first compressed stream; compressing the first compressed stream in a second compression section to produce a second compressed stream; compressing the second compressed stream in a third compression section to produce a third compressed stream; cooling the third compressed stream to approximately ambient temperature to form a cooled third compressed stream, wherein the cooled third compressed stream is a two phase fluid; separating the cooled third compressed stream into a liquid refrigerant and a gas refrigerant; expanding the gas refrigerant to produce a cooled refrigerant; and introducing the cooled refrigerant to the main heat exchanger under conditions effective for providing refrigeration for the method;

the method can also include an absence of a cooling step between each of the three compressing steps;

the method can also include an absence of a cooling step between the second and third compressing steps;

the method can also include the step of expanding the liquid refrigerant and combining the expanded liquid refrigerant with the cooled refrigerant prior to the step of introducing the cooled refrigerant to the main heat exchanger;

the method can also include the step of cooling the first compressed stream prior to compressing said first compressed stream in the second compression section; and/or during the step of cooling the first compressed stream, the first compressed stream is cooled to a temperature sufficiently warm enough to prevent formation of a liquid phase.

In another embodiment of the invention, an apparatus is provided for the liquefaction of ethane using a mixed refrigerant refrigeration cycle with demethanization. In this embodiment, the apparatus can include: a conduit configured to provide an ethane feed under pressure, wherein the ethane feed is comprised primarily of ethane, wherein the ethane further comprises methane; a first cooler configured to cool the ethane feed to a first temperature in a first heat exchanger, wherein the first temperature is sufficiently warm to prevent ice formation; a dryer system configured to remove water from the ethane feed upstream or downstream the first heat exchanger to form a dry ethane feed; means for splitting the dry ethane feed into a first portion and a second portion; a main heat exchanger in fluid communication with the means for splitting the dry ethane, wherein the main heat exchanger is configured to cool the first portion of the dry ethane feed to form a partially cooled ethane stream; a distillation column having a top section, an intermediate section, and a bottom section, wherein the intermediate section of the distillation column is in fluid communication with the main heat exchanger such that the distillation column is operable to receive the partially cooled ethane stream into the first intermediate location of the distillation column under conditions effective to cause an ethane rich liquid to accumulate near the bottom portion of the distillation column and a methane rich gas to accumulate near the top portion of the distillation column; an expansion device configured to expand the second portion of the dry ethane feed; a phase separator in fluid communication with the expansion device, such that the phase separator is configured to receive the expanded second portion of the dry ethane feed; a top gas conduit configured to transfer a top gas from the top of the phase separator to the heat exchanger, such that the top gas is cooled in the main heat exchanger; a cooled top gas conduit in fluid communication with the heat exchanger and the distillation column, such that the cooled top gas conduit is configured to transfer the cooled top gas into a second intermediate location of the distillation column, wherein the second intermediate location is located at least one tray above the first intermediate location; a bottom liquid conduit in fluid communication with the phase separator and the distillation column, the bottom liquid conduit being configured to transfer a bottom liquid from the bottom of the phase separator to a third intermediate location of the distillation column, wherein the third intermediate location is located at least one tray below the first intermediate location; a bottom conduit in fluid communication with the bottom section of the distillation column and the heat exchanger, such that the heat exchanger is configured to receive the ethane rich liquid from the distillation column; and a mixed refrigerant refrigeration cycle configured to provide refrigeration used to cool the ethane rich liquid to produce a liquid ethane product.

In optional embodiments of the apparatus for liquefaction of ethane:

- the apparatus can also include a top conduit in fluid communication with the top section of the distillation column and the heat exchanger, such that the heat exchanger is configured to receive the methane rich gas from the top section of the distillation column and subsequently cool the methane rich gas to form a partially condensed top gas;
- the apparatus can also include a gas/liquid separator configured to receive the partially condensed top gas from the heat exchanger and to separate the condensed liquid from the non-condensables, wherein the gas/liquid separator is in fluid communication with the distillation column such that the top section of the distillation column is configured to receive condensed liquid from the gas/liquid separator as a reflux fluid;
- the gas/liquid separator can include a top portion that is in fluid communication with an expansion device and the heat exchanger such that the expansion device is configured to receive the non-condensables from the gas/liquid separator and expand the non-condensables before the non-condensables are warmed in the heat exchanger to form a process fuel gas, wherein the process fuel gas comprises a higher percentage of methane as compared to the methane rich gas withdrawn from the top second of the distillation column;
- the first cooler is a bottom reboiler of the distillation column, such that the ethane feed acts as a reboiling fluid for the distillation column;
- the bottom reboiler is a bath-type reboiler and is disposed within the bottom portion of the distillation column and the bottom liquid provides the bath fluid;
- the bottom reboiler is disposed outside of the distillation column;
- the apparatus can also include an expansion device configured to expand the partially cooled ethane stream prior to introduction to the distillation column;
- the mixed refrigerant comprises a heavy hydrocarbon selected from the group consisting of butane, pentane, and combinations thereof;
- the mixed refrigerant further comprises a light hydrocarbon selected from the group consisting of methane, ethane, ethylene, propane, and combinations thereof;
- the mixed refrigerant cycle can include: a series of compression stages configured to compress the mixed refrigerant, a cooling unit disposed between each compression stage, a gas/liquid separator disposed downstream each cooling unit, wherein the gas/liquid is configured to remove liquid refrigerant from the mixed refrigerant prior to a subsequent compression stage; an expansion device configured to expand the liquid refrigerant; and a second expansion device configured to expand the compressed mixed refrigerant; and/or
- the ethane feed is at a pressure of at least 15 bar(a).

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

The FIGURE shows an embodiment of the present invention.

DETAILED DESCRIPTION

While the invention will be described in connection with several embodiments, it will be understood that it is not intended to limit the invention to those embodiments. On the contrary, it is intended to cover all the alternatives, modifications and equivalence as may be included within the spirit and scope of the invention defined by the appended claims.

A flow diagram for the refrigeration cycle 140 can be found on the right side of the FIGURE. As compared to the liquefaction of natural gas (e.g., typically greater than 90% methane), a mixed refrigerant for use for the liquefaction of ethane will preferably contain high concentrations of heavier components (e.g., butane and pentane). However, as the butane and pentane composition increases in the refrigerant mix, the refrigerant stream is partially liquefied by the interstage cooling. This occurs because the heavier components liquefy at warmer temperatures than lighter components. The liquid from each stage is preferably removed prior to the next compression stage to prevent mechanical damage to the subsequent compression stage. This liquid is cooled and flashed to recover refrigeration as shown in the FIGURE.

According to the FIGURE, low pressure mixed refrigerant 134 is compressed in first compression section (which may comprise one or more compression stages) 160 to form medium pressure mixed refrigerant 162, which is then cooled in first after cooler 170 to form pre-cooled medium pressure (MP) mixed refrigerant 172. Pre-cooled medium pressure mixed refrigerant 172 is subsequently fed to first gas/liquid separator 180 with condensed medium pressure mixed refrigerant 182 being cooled in main liquefaction heat exchanger 20 to form cooled MP mixed refrigerant 186. Gaseous medium pressure mixed refrigerant 184 is withdrawn from the top of first gas/liquid separator 180 and compressed in second compression stage 190 to form high pressure (HP) mixed refrigerant 192, which is then cooled in second after cooler 200 to form pre-cooled HP mixed refrigerant 202. Pre-cooled HP mixed refrigerant 202 is then cooled in main liquefaction heat exchanger 20 to form cooled HP mixed refrigerant 211, before being expanded across valve 220 to form cold low pressure (LP) mixed refrigerant 222. Similarly, cooled MP mixed refrigerant 186 is expanded across valve 210 to form cold LP mixed refrigerant 212. Cold LP mixed refrigerant 212 can then be combined with cold LP mixed refrigerant 222 and warmed together in main liquefaction heat exchanger 20, or cold LP mixed refrigerant 212 and cold LP mixed refrigerant 222 can be warmed as separate streams within main liquefaction heat exchanger 20 (not shown).

Those of ordinary skill in the art will recognize that the decision as to where to combine streams 212 and 222 (i.e., at the cold end, intermediate section, or warm end of exchanger 20) is based on the optimization of the heating curve to the cooling curve in exchanger 20. For example, if streams 212 and 222 vaporized as separate streams, they will each vaporize at two different temperatures because cold LP mixed refrigerant 212 is rich in heavy hydrocarbons and cold LP mixed refrigerant 222 is rich in lighter components.

However, if they are combined into a single stream the resulting mixture composition will vaporize at an intermediate temperature. Embodiments of the present invention may combine the two streams at either the cold end or warm end, or any intermediate location in between. The combined warmed cold LP mixed refrigerant 212 and cold LP mixed refrigerant 222 form low pressure mixed refrigerant 134 to complete the mixed refrigeration cycle 140.

The refrigeration cycle of the method shown in the FIGURE yields a thermodynamically optimal solution, however, it comes at the expense of having to employ a somewhat complex exchanger, and a process that can be a challenge to control since the quantity of liquid formed at each intercooler is fairly sensitive to its pressure and temperature at the intercoolers. Consequently, it is preferred to control the temperatures at the intercoolers in order to compensate for fluctuations in the cooling medium, which often is related to ambient conditions. If the interstage liquid quantities cannot be precisely controlled, the liquefaction in main exchanger will likely be significantly penalized. This is because the design of the main heat exchange is sensitive to controlling these flow rates. Alternatively, as those skilled in the art would recognize, liquid stream 182 may be pumped to increase its pressure equal to that of stream 202. The pumped liquid stream can be mixed with stream 202 and then introduced into main exchanger 20. Therefore having a single refrigeration loop which is less sensitive to temperature fluctuations at separator 180.

In an embodiment not shown, the refrigeration cycle shown in the FIGURE can be replaced with one having no interstage cooling (e.g., absence of first after cooler 170) or can be cooled to a temperature that is still warm enough to prevent liquid formation (and thus liquid/gas separator 180 can be eliminated). In one embodiment, not shown, there are three compression stages, such that mixed refrigerant can be compressed in a first, second and third stage of a compressor (or in three separate compressors), without any cooling between the various compression steps to avoid liquid formation. The compressed stream is cooled in aftercooler and sent to a liquid/gas separator, wherein the liquid is cooled within the heat exchanger. The gas is partially cooled in the heat exchanger, and then expanded in a valve. Following cooling, the liquid and expanded gas can be introduced to a second phase separator, and these streams are used to provide the refrigeration for the system The flow diagram for the liquefaction of the ethane feed stream may be found on the left side of the FIGURE. In the FIGURE, ethane feed 2 is cooled in bottom reboiler 10 to form pre-cooled ethane feed 12, which is then sent to water removal unit 15 (e.g., dryer system) for removal of water resulting in dry ethane feed 17. Although the preferred embodiment is to have the dryer system after precooling in exchanger 10 since the amount of water that can be contained in a gas is significantly reduced at colder temperatures, alternatively, the dryer system may be upstream of exchanger 10 for plant layout arrangement purposes. Dry ethane feed 17 is then split into two fractions, with first fraction 18 being optionally expanded in a valve before being partially cooled in main liquefaction heat exchanger 20 to form partially cooled ethane 22 and then expanded across valve 30 to form expanded partially cooled ethane 32, which is then introduced to a middle portion of distillation column 40 under conditions effective to separate methane and other light components, which can be found in greater concentrations at the top of distillation column 40, from ethane and other heavier components, which can be found in greater concentrations at the bottom of distillation column 40.

Second fraction 19 is expanded and sent to phase separator 25. The resulting top gas 27 is then withdrawn, cooled in main liquefaction heat exchanger 20, and introduced to the distillation column at a second intermediate location that is located at least one tray above where expanded partially cooled ethane 32 is introduced to the distillation column. Bottom liquid 29 is withdrawn from phase separator 25 and introduced to a third intermediate location of the distillation column that is at least one tray below where expanded partially cooled ethane 32 is introduced to the distillation column. In an optional embodiment not shown, bottom liquid 29 can be cooled, for example in main liquefaction heat exchanger 20, prior to entering column 40.

In one embodiment, top gas 27 from phase separator 25 will be richer in the lighter component (e.g., methane), such that after top gas 27 is liquefied in the main liquefaction heat exchanger 20, it can be sent to the distillation column at a second intermediate location that is located at least one tray higher than the first intermediate location. This advantageously provides more reflux at a higher location in the column. Bottom liquid 29 from phase separator 25, which is richer in the heavier component ethane, is optionally cooled and then sent to a third intermediate location that is located at least one tray below the first intermediate location. Preferably, the third intermediate location is at a lower part of the column which matches the composition of the liquid with the fluid within the distillation column at that location. By sending the methane rich vapor stream to a higher location in the column, the distillation is improved since the duty of the primary condenser can be reduced, thereby improving the overall liquefaction power of the plant. In the embodiment shown, the primary condenser is main liquefaction heat exchanger 20 acting on streams 42, 44, and feeding liquid 52 back to the column as reflux. Additionally, by adding another liquid reflux stream (e.g., stream 27), the duty of the primary condenser can be reduced.

Top gas 42 of distillation column 40, which is methane rich as compared to expanded partially cooled ethane 32, is withdrawn from the top portion of distillation column 40 partially cooled in main liquefaction heat exchanger 20 to a temperature effective for condensing components heavier than methane to form partially condensed top gas 44, which is then sent to gas/liquid separator 50 in order to separate condensed liquids 52 from non-condensables 54. Condensed liquids 52 is then sent back to the top portion of distillation column 40 as reflux and non-condensables 54 can be expanded across valve 60, warmed in main liquefaction heat exchanger 20 to form process fuel gas 62, which is then either used as fuel in the process or another nearby process.

In the embodiment shown, reboiler 10 is a bath type condenser/reboiler. As such, bottoms liquids accumulating in the bottom of distillation column 40 help to cool the incoming ethane feed 2, while ethane feed 2 simultaneously acts as a reboiling fluid. In an embodiment not shown, reboiler 10 can be located outside of distillation column 40. In this embodiment, a bottoms liquid, which is ethane rich as compared to expanded partially cooled ethane 32, is withdrawn from the bottom portion of distillation column 40, warmed in bottom reboiler 10 against ethane feed 2 to form a bottoms reboil stream, which is then sent back to the bottom portion of distillation column 40 as a reboil stream. As with the embodiment shown in the FIGURE, this embodiment uses the ethane feed as a reboiling fluid. In another embodiment not shown, any warm mixed refrigerant stream such as 162, 172, 192, or 202 could be used as a reboiling fluid instead of or in addition to ethane feed 2.

Pressurized ethane stream 48 is withdrawn as a liquid from the bottom portion of distillation column 40, further cooled in main liquefaction heat exchanger 20 to form pressurized liquid ethane stream 24, preferably expanded across valve 70 to form low pressure liquid ethane 72, which is then fed to liquid ethane storage tank 80 for storage as product.

The liquefaction is more efficient at high pressure due to the physical properties latent heat of condensation curves. However, distillation is more efficient at low pressure due to equilibrium properties. Therefore the distillation pressure (which is also the liquefaction pressure) is chosen as a compromise between distillation and liquefaction steps. In a preferred embodiment, this pressure is about 20 bar. Once liquefied, the pressurized liquid is preferably subcooled such that the product is near saturated liquid conditions after it is reduced in pressure to the tank pressure.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations that fall within the spirit and broad scope of the appended claims. The present invention may suitably comprise, consist or consist essentially of the elements disclosed and may be practiced in the absence of an element not disclosed. Furthermore, language referring to order, such as first and second, should be understood in an exemplary sense and not in a limiting sense. For example, it can be recognized by those skilled in the art that certain steps or devices can be combined into a single step/device.

The singular forms "a", "an", and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

We claim:

1. An apparatus for the liquefaction of ethane using a mixed refrigerant refrigeration cycle with demethanization, the apparatus comprising:

a conduit configured to provide an ethane feed under pressure, wherein the ethane feed is comprised primarily of ethane, wherein the ethane further comprises methane;

a first cooler configured to cool the ethane feed to a first temperature in a first heat exchanger, wherein the first temperature is sufficiently warm to prevent ice formation;

a dryer system configured to remove water from the ethane feed upstream or downstream the first heat exchanger to form a dry ethane feed;

means for splitting the dry ethane feed into a first portion and a second portion;

a main heat exchanger in fluid communication with the means for splitting the dry ethane, wherein the main heat exchanger is configured to cool the first portion of the dry ethane feed to form a partially cooled ethane stream;

a distillation column having a top section, an intermediate section, and a bottom section, wherein the intermediate section of the distillation column is in fluid communication with the main heat exchanger such that the distillation column is operable to receive the partially cooled ethane stream into the first intermediate location of the distillation column under conditions effective to cause an ethane rich liquid to accumulate near the bottom portion of the distillation column and a methane rich gas to accumulate near the top portion of the distillation column;

an expansion device configured to expand the second portion of the dry ethane feed;

a phase separator in fluid communication with the expansion device, such that the phase separator is configured to receive the expanded second portion of the dry ethane feed;

a top gas conduit configured to transfer a top gas from the top of the phase separator to the heat exchanger, such that the top gas is cooled in the main heat exchanger;

a cooled top gas conduit in fluid communication with the heat exchanger and the distillation column, such that the cooled top gas conduit is configured to transfer the cooled top gas into a second intermediate location of the distillation column, wherein the second intermediate location is located at least one tray above the first intermediate location;

a bottom liquid conduit in fluid communication with the phase separator and the distillation column, the bottom liquid conduit being configured to transfer a bottom liquid from the bottom of the phase separator to a third intermediate location of the distillation column, wherein the third intermediate location is located at least one tray below the first intermediate location;

a bottom conduit in fluid communication with the bottom section of the distillation column and the heat exchanger, such that the heat exchanger is configured to receive the ethane rich liquid from the distillation column; and a mixed refrigerant refrigeration cycle configured to provide refrigeration used to cool the ethane rich liquid to produce a liquid ethane product.

2. The apparatus as claimed in claim 1, further comprising a top conduit in fluid communication with the top section of the distillation column and the heat exchanger, such that the heat exchanger is configured to receive the methane rich gas from the top section of the distillation column and subsequently cool the methane rich gas to form a partially condensed top gas.

3. The apparatus as claimed in claim 2, further comprising a gas/liquid separator configured to receive the partially condensed top gas from the heat exchanger and to separate the condensed liquid from the non-condensables, wherein the gas/liquid separator is in fluid communication with the distillation column such that the top section of the distillation column is configured to receive condensed liquid from the gas/liquid separator as a reflux fluid.

4. The apparatus as claimed in claim 3, wherein the gas/liquid separator comprises a top portion that is in fluid communication with an expansion device and the heat exchanger such that the expansion device is configured to receive the non-condensables from the gas/liquid separator and expand the non-condensables before the non-condensables are warmed in the heat exchanger to form a process fuel gas, wherein the process fuel gas comprises a higher percentage of methane as compared to the methane rich gas withdrawn from the top second of the distillation column.

5. The apparatus as claimed in claim 1, wherein the first cooler is a bottom reboiler of the distillation column, such that the ethane feed acts as a reboiling fluid for the distillation column.

6. The apparatus as claimed in claim 5, wherein the bottom reboiler is a bath-type reboiler and is disposed within the bottom portion of the distillation column and the bottom liquid provides the bath fluid.

7. The apparatus as claimed in claim 5, wherein the bottom reboiler is disposed outside of the distillation column.

8. The apparatus as claimed in claim 1, further comprising an expansion device configured to expand the partially cooled ethane stream prior to introduction to the distillation column.

9. The apparatus as claimed in claim 1, wherein the mixed refrigerant comprises a heavy hydrocarbon selected from the group consisting of butane, pentane, and combinations thereof.

10. The apparatus as claimed in claim 9, wherein the mixed refrigerant further comprises a light hydrocarbon selected from the group consisting of methane, ethane, ethylene, propane, and combinations thereof.

11. The apparatus as claimed in claim 1, wherein the mixed refrigerant cycle comprises: a series of compression stages configured to compress the mixed refrigerant, a cooling unit disposed between each compression stage, a gas/liquid separator disposed downstream each cooling unit, wherein the gas/liquid is configured to remove liquid refrigerant from the mixed refrigerant prior to a subsequent compression stage; an expansion device configured to expand the liquid refrigerant; and a second expansion device configured to expand the compressed mixed refrigerant.

12. The apparatus as claimed in claim 1, wherein the ethane feed is at a pressure of at least 15 bar(a).

* * * * *